US005928424A

United States Patent [19]

Krebs et al.

[11] Patent Number: 5,928,424

[45] Date of Patent: Jul. 27, 1999

[54] DEVICE FOR IMPREGNATING A WEB LATERALLY GUIDED IN THE WIDTH DIRECTION

[75] Inventors: Stefan Krebs, Krefeld; Johannes Nolden, Willich, both of Germany

[73] Assignee: Eduard Küsters Maschinenfabrik GmbH & Co. KG, Krefeld, Germany

[21] Appl. No.: 08/776,081

[22] PCT Filed: Jul. 21, 1995

[86] PCT No.: PCT/DE95/00961

§ 371 Date: Mar. 20, 1997

§ 102(e) Date: Mar. 20, 1997

[87] PCT Pub. No.: WO96/03539

PCT Pub. Date: Feb. 8, 1996

[30] Foreign Application Priority Data

Jul. 21, 1994 [DE] Germany ..... 94 11 816 U

[51] Int. Cl.[6] ..... B05C 3/02

[52] U.S. Cl. ..... 118/405; 118/419; 118/424; 118/56

[58] Field of Search ..... 118/405, 419, 118/420, 427, 428, 423, 424, 56; 68/22 R, 181 R, 175

[56] References Cited

U.S. PATENT DOCUMENTS

| | | | |
|---|---|---|---|
| 2,784,583 | 3/1957 | Dungh et al. | 66/22 R |
| 3,207,616 | 9/1965 | Cohn et al. . | |
| 3,332,260 | 7/1967 | Bisang . | |
| 3,881,445 | 5/1975 | Nothiger | 118/405 |
| 5,195,201 | 3/1993 | Schlicht | 68/22 R |

FOREIGN PATENT DOCUMENTS

| | | |
|---|---|---|
| 1460288 | 11/1963 | Germany . |
| 1460265 | 1/1969 | Germany . |
| 1460355 | 1/1970 | Germany . |
| 3733996A1 | 4/1989 | Germany . |

*Primary Examiner*—Brenda A. Lamb
*Attorney, Agent, or Firm*—Kenyon & Kenyon

[57] ABSTRACT

The device for impregnating a web laterally guided in the width direction with a treatment liquid comprises a tank for the treatment liquid through which the web is taken on an impregnation section and a pair of squeeze rollers arranged above the tank between which the web can be taken from below immediately after leaving the tank. The tank takes the form of an upright flat channel, the flat sides of which are tightly opposed, through which the web can be taken upwards, which can be kept full up to an optional level and the lower end of which is limited by a resilient sealing arrangement bearing on the web from both sides.

24 Claims, 3 Drawing Sheets

DEVICE FOR IMPREGNATING A WEB LATERALLY GUIDED IN THE WIDTH DIRECTION

BACKGROUND OF THE INVENTION

The invention relates to a device for impregnating a web, in particular for impregnating a web laterally guided in the width direction with a treatment of fluid.

An application device with a flat, upright channel which can be filled with treatment liquid, with a sealing arrangement of the type described initially, is actually known from DE-OS 14 60 265. However, in the known embodiment, the web is guided through the flat channel from the top to the bottom, and the squeeze rollers are arranged below the channel. They form a gore in which the treatment fluid which is squeezed off collects, and from which it is passed away laterally and brought back to a collecting tank, from which the supply tank can be refilled. This application device meets the general goal in textile technology of constantly reducing the amounts of treatment liquid in the apparatuses.

However, the arrangement of the pair of squeeze rollers below the supply tank, which is accompanied by filling of the gore with treatment liquid and the necessity of lateral sealing of the gore, is also not advantageous when viewed from the aspect of uniformly squeezing off a selectable application amount, since a certain minimum pressure is required to seal the squeeze nip towards the bottom, which is equivalent to a maximum application amount.

Devices with pairs of squeeze rollers located above the supply tank are generally known in the form of a foulard, e.g. from DE 1 078 527 and DE 1 054 048. Here, the web is passed from above into a trough which is open towards the top and contains the treatment liquid. The web is deflected upward over a deflection roller located near the bottom of the trough. After exiting from the treatment liquid in the trough, the web is squeezed by means of the pair of squeeze rollers arranged above the trough. The liquid which is squeezed off runs back into the trough via a guide surface.

Because of the presence of the deflection roller, the volume of the trough is rather large, for design reasons. It is also known to house displacement elements in the trough, but there is still a significant volume of liquid which must be stored or disposed of after the end of treatment or if the treatment liquid is changed. Careful cleaning is difficult due to the presence of the displacement elements.

Accordingly, an object of the invention is the further development of a treatment device of the type stated, in such a way that the disadvantages of gore formation are avoided.

SUMMARY OF THE INVENTION

These and other objects are accomplished by providing a device for impregnating a web laterally guided in the width direction with a treatment liquid. The device includes a tank for the treatment liquid through which the web is taken on an upright impregnation section, and which is formed by an upright flat channel, the flat sides of which are tightly opposed, which can be kept full up to an optional level. The lower end of the channel is limited by a resilient sealing arrangement bearing on the web from both sides. A pair of squeeze rollers are included, between which the web can be taken. The pair of squeeze rollers is arranged above the tank, and the web can be taken through the tank from bottom to top, and through the pair of squeeze rollers from below immediately after leaving the tank.

While the flat trough of a known foulard can hold the amount of liquid without sealing problems because of its trough shape, for this purpose it requires an interior which can hold the incoming section, the outgoing section of the web and the deflection roller.

This trough is replaced in the present invention by the upright, flat channel through which the web passes only once, from bottom to top, and which is limited, i.e. sealed with regard to liquids, at the bottom end by the sealing arrangement. The seal relative to the moving web replaces the closed design of the trough, where the latter, however, requires the web sections to be passed through twice.

The channel is supposed to be "flat." This means that the clear distance between the level flat sides of the channel which stand opposite and parallel to one another is just large enough for a web to be loosely passed through it guided in the width direction. For the impregnation effect, it does not matter whether the web comes closer to one flat surface or the other as it passes through the channel. The specific distance dimension to be chosen in an individual case depends on the material. A material such as a cotton fabric requires only a slight distance, as compared with a fluffy material or one with a nap.

The arrangement of the flat sides of the flat channel at the smallest possible distance from the web has the effect, on the one hand, that the volume of treatment liquid in the channel can be kept low, and, in the case of a web with a width of 1800 mm, amounts to only about 11 liters. Such a small amount is quickly "used up" by the web passing through, so that there are no problems with any depletion of the liquid.

On the other hand, however, the flatness of the channel also has an effect on the physical efficacy of impregnation. Because the flat sides of the channel are so close to the web, a flow interaction occurs, in that strong turbulent flow layers occur on both sides of the web, the pressure pulsations of which promote de-aeration of the web and therefore penetration of the treatment liquid into the web. The degree of efficacy of impregnation, over a comparable impregnation distance, clearly increases as compared with conditions in a conventional foulard tank.

Because of the arrangement of the pair of squeeze rollers above the channel, the problems of the filled gore and the limited application amount are eliminated.

The sealing arrangement at the bottom end of the channel can be made such that the flat channel is delimited, at its bottom end, at least on one side of the web, in a zone reaching crosswise across the web, by a flexible wall which can be inflated against the web by a fluid pressure medium, resting tightly against it and forming a seal by pressing against a counter-surface on the other side of the web. Furthermore, inflatable, flexible walls may be provided on both sides of the web, and the flexible walls may be formed by inflatable hoses which lie opposite one another. However, this is actually known, for example from DE-OS 14 60 268 and DE-OS 14 60 265.

The flat channel consists of rigid material. The flat sides of the flat channel consist of two rectangular plates which are arranged opposite and parallel to one another at a distance, which are tightly connected with one another on the upright edges by means of edge ridges made of a rectangular profile, arranged between them. Materials for the channel are suitable plastics or corrosion-resistant steel. In the preferred exemplary embodiment, the clear distance between the flat sides of the channel is approximately 6 to 15 mm. Generally, a size on the order of about 10 mm is possible.

In a manner which is actually known, where application of the treatment liquid to be supplied, onto the run-off surfaces, is actually evident from DE 37 33 996 C 2, the supply of liquid to the flat channel can be provided from above. Also, at the top end of the channel, in a plane perpendicular to the web, run-off surfaces which are inclined downward towards the inside of the channel are provided, onto which the treatment liquid can be applied outside of the footprint of the channel.

In order to maintain foulard-like properties for the impregnation device, also with regard to recirculation of the treatment liquid squeezed off, guide surfaces are provided on both sides of the web, below the pair of squeeze rollers, in a vertical plane perpendicular to the web, inclined towards the channel, reaching to above the run-off surfaces, for the treatment liquid squeezed off by the squeezing system.

In an arrangement of the hose section, the flat channel ends, at the bottom, just above the sealing arrangement, and is surrounded, at the bottom end, by a hose section. This hose section is closed in horizontal cross-section and tightly surrounds the channel, which section extends down through the sealing arrangement to below the latter, in the flattened state. This arrangement of the hose section is particularly important and forms a problem-free and inexpensively implemented seal between the end of the rigid channel and the inflatable hoses, and particularly ensures a seal with regard to the sides of the web, easily and without being bound to a certain web width.

A similar hose section is also seen in DE 14 60 265 A 1, but there it is arranged inside the flat channel and attached at its upper edge. Because of the height of the dipping or impregnation section, which might be large for the invention under certain circumstances, this results in the necessity of arranging a rather long hose section, with the corresponding costs, where the material really has no sealing function to fulfill outside of the actual sealing zone. In the invention, on the other hand, the hose section only has to bridge the zone between the bottom end of the flat channel and the sealing arrangement arranged below it.

The characteristic of affixing the hose section on the outside, on the flat channel, is particularly important if a slip film is to be provided at the same time, to facilitate having the web slide through between the inflatable hoses which are opposite one another. It is reasonable that for the exemplary embodiment known from DE 14 60 265 A 1, such a slip film would be applied only at the top edge of the channel. The slip films would then have to extend over the entire height of the flat channel, or be affixed to the hose section at half the height. Both solutions are disadvantageous in terms of design. In the invention, however, slip films which extend over the width of the web are attached on the outside of the flat sides of the flat channel, but within the hose section, with their top edge, and extend downward through the sealing arrangement to below the latter, are fixed in place there in the movement direction of the web, and rest against both sides of the web under the pressure force of the sealing arrangement. In this case, the slip films can have an optimum short length, without causing any problems in being held in place against the tension of the web.

The hose section and the attachment of the slip films are characteristics which can also be applied independent of the question whether or not squeeze rollers are applied above the top end of the flat channel. These characteristics are therefore important in their own right.

The device may have at least one inflatable, flat, rectangular bag, which is intended to be inserted into the flat channel. The bag extends over its height with one rectangle side but not over its entire width with the other rectangle side, and fills the rectangular region taken up by the bag as a displacement element, in the inflated state. This structure is practical for use and it permits the production of test samples with a small width, under production-like conditions, without using a large amount of treatment liquid. In this connection, a region of the channel corresponding to the width of the rectangular bag is filled in such a way that no treatment liquid can penetrate into this region. Only the residual width of the channel remains, for example on one side, through which a narrow strip of a textile material can be passed and in which only a very small amount of treatment liquid is present. The sample strip is treated in the same way as would be the case later for a wider web. In this way, samples can be produced which are closer to production conditions than those produced on a laboratory machine separate from the system.

A rigid strip is affixed at the top edge of the bag, which can be set onto the top end of the flat channel. When a sample is to be produced, the bag is inserted into the channel from above, where the rigid strip forms the contact point at the top end of the channel and holds the bag in the correct position. It is practical if the connection for inflating the bag is also provided on the rigid strip.

A practical development is a weighting rod which is provided at the bottom end of the bag and ensures that the bag, which consists of flexible plastic film, can easily be suspended into the flat channel under the weight of the weighting rod.

When production of samples is finished, the air is let out of the bag and the bag is removed, whereupon the entire width of the flat channel is again available for passing the web through.

DETAILED DESCRIPTION OF THE DRAWINGS

Figure 1:
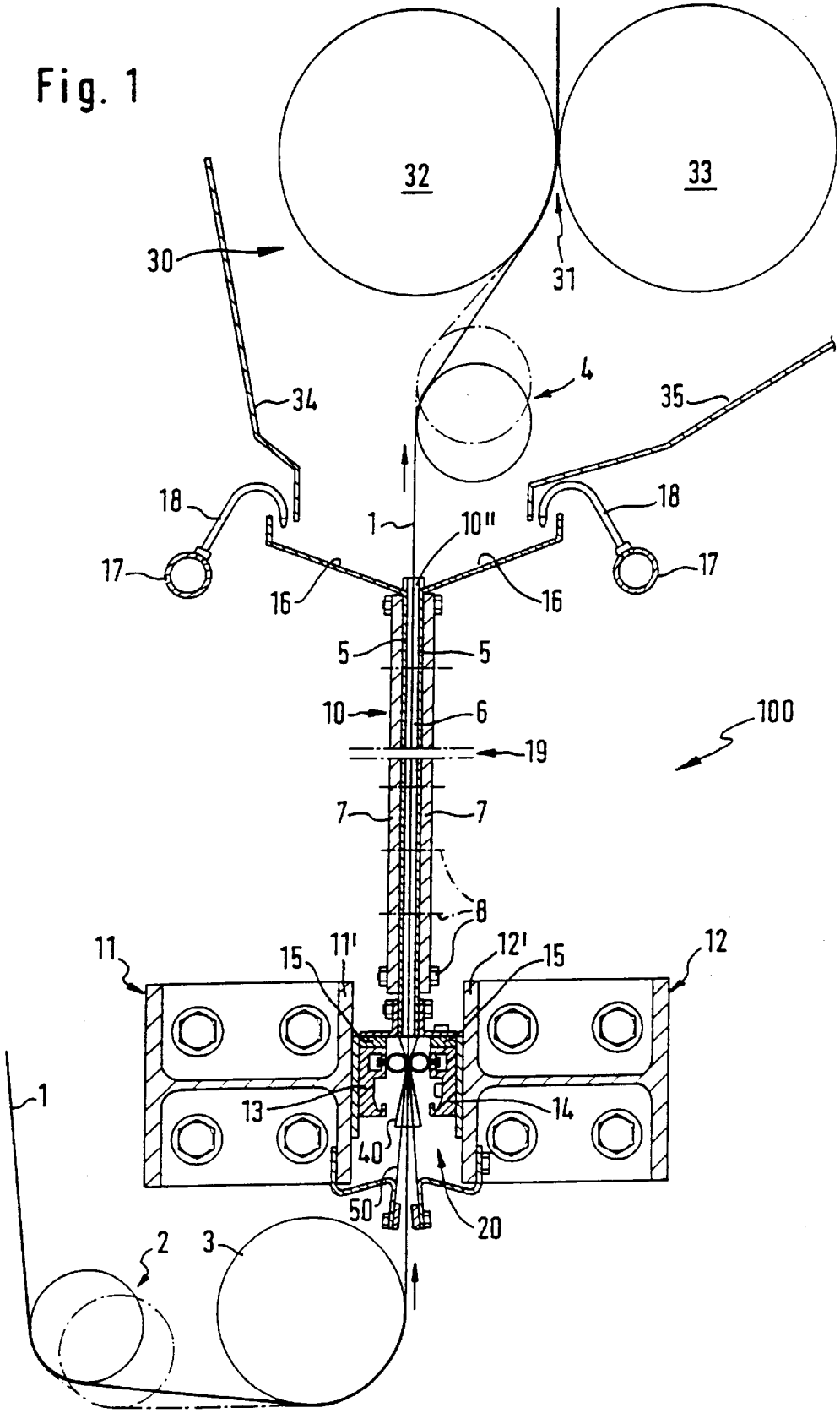
FIG. 1 shows a vertical cross-section through an impregnation device, perpendicular to the web.

The impregnation device indicated as a whole with 100 in FIG. 1 serves to impregnate a web 1, for example a textile web, with a treatment liquid with a predetermined moisture content. The impregnation device 100 comprises an upright, flat channel 10, which can be filled with the treatment liquid and through which the web 1 passes from the top to the bottom. Towards the bottom, the flat channel is closed off by a sealing arrangement 20, which rests against the web 1 from both sides, and which prevents the treatment liquid from running down out of the flat channel 10.

A squeezing system 20 with two squeeze rollers 32, 33 that work against each other is arranged above the flat channel 10; the rollers squeeze the web 1 impregnated in the flat channel 10 to a predetermined moisture content, so that a certain amount of treatment liquid remains on the web 1, in a uniform distribution.

The web 1 passes from above over a width-stretching roller 2 arranged below the impregnation device 100, is deflected by about 90° there, and reaches a deflection roller 3 in an approximately horizontal position. From the right side in FIG. 1, the web runs vertically upward and via another width-stretching roller 4 above the flat channel 10, and there runs into the roller nip 31 of the squeeze rollers 32 and 33.

The flat channel 10 consists of two rectangular plates of sheet metal which are arranged opposite and parallel to one another at a slight distance, forming the flat sides 5, 5 of the channel 10. The longer sides of the rectangular plates are placed in the width direction of the web. A spacer profile 6, rectangular in cross-section, is arranged between the upright, shorter sides, at the edge in each instance, and on the outside, shim profiles 7, 7 are opposite these spacer profiles. The whole is connected by means of a series of screws 8 and sealed in a suitable manner, so that a closed channel is obtained in horizontal cross-section. At the top and the bottom, the flat channel 10 is open. At the bottom end of the flat channel 10, a support construction is provided, of which only two I-beams 11, 12 are shown, opposite one another at the same height. The beams 11, 12 are located opposite one another at a distance, with a cross-brace 11', 12' in each instance. In the spacer space, holder pieces 13, 14, 15 are mounted on the cross-braces 11', 12', holding the bottom end of the flat channel 10 and the sealing arrangement 20 in place. If necessary, the flat channel 10 can also be supported at another point, in a manner not shown.

At the top end 10", the plates or pieces of sheet metal forming the flat sides 5, 5 of the flat channel 10 are angled off towards the outside and form run-off surfaces 16 which are inclined inward, via which the treatment liquid runs down into the top end of the flat channel 10 in the form of a film or layer, at a slant. Outside of the run-off surfaces 16, supply pipes 17 for the treatment liquid are provided; they are horizontal and extend parallel to the flat sides 5, 5, and are supplied with liquid in a suitable manner. The supply pipes 17 are connected with a plurality of consecutive small elbows, in the width direction, which are bent like canes and reach over the top edge of the run-off surfaces 16. The treatment liquid, applied to the run-off surfaces 16 by the small elbows 18 at a plurality of rather closely spaced locations, flows down over the run-off surfaces 16 and becomes uniform in the process, so that the flat channel 10 can be kept filled without significant differences in level in the width direction of the web 1.

The squeeze rollers 32, 33 are provided above the run-off surfaces 16 and the small elbows 18, in the region of the footprint of the flat channel 10 with its support arrangement. The treatment liquid squeezed off in the roller nip 31 either flows down along the web 1 or drips off. In order to catch this treatment liquid, guide surfaces 34, 35 are provided on both sides of the web 1, which catch the treatment liquid occurring below and to the side of the squeeze rollers 32, 33, and pass it to the run-off surfaces 16, where it is brought back into the flat channel 10.

Figure 2:
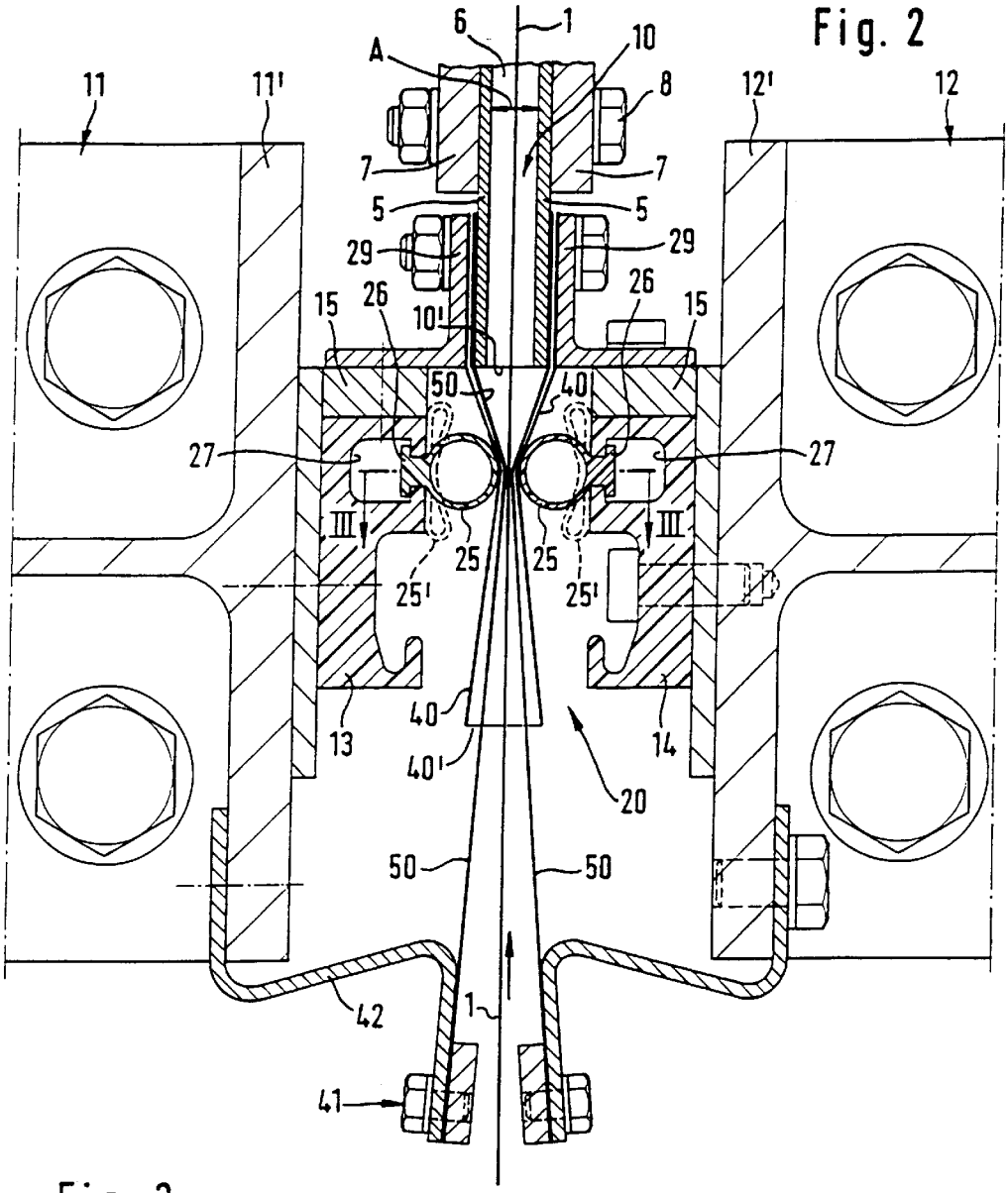
FIG. 2 shows the region of the sealing arrangement from the bottom of FIG. 1, on a larger scale.

In FIG. 2, the region of the sealing arrangement 20 from FIG. 1 is shown on a larger scale. The sealing arrangement 20 comprises two inflatable hoses 25 which are opposite one another on both sides of the web 1, at the same height, and which have T-shaped ribs on the back, continuous in the lengthwise direction, which engage into corresponding undercut recesses 27 of the holder pieces 13 and 14, respectively. In the completely inflated state, the hoses 25 rest against one another with pressure. In the pressure-free or evacuated state, they are flat, as indicated with broken lines at 25' in each instance. The arrangement of the hoses 25, 25 is made in such a way that in the inflated state, they hold the web 1 in the center of the flat channel 10.

The sealing arrangement 20 is arranged just below the bottom end 10' of the flat channel 10. In the region of the bottom edge, the flat channel 10 is surrounded on its outside by a short hose section 40 made of plastic film which tightly encloses the flat channel 10. In other words, the hose section 40 is dimensioned, in its horizontal cross-section, in such a way that it precisely fits around the flat channel 10 and can be sealed relative to it, if necessary using sealing agents. The hose section is clamped in place between the outside of the flat sides 5 and holder brackets 29, which are supported on the holder pieces 15 or 13 and 14, respectively. The hose section 40 hangs down over the bottom end 10' of the flat channel 10 and passes between the hoses 25, 25, and then extends slightly further to its bottom edge 40'.

Between the holder brackets 29 and the outside of the flat sides 5, a slip film 50 is also clamped in place with its top edge, on each side of the web 1, on the inside of the hose section 40. The slip films 50 extend within the hose section 40 through the gap between the hoses 25, 25, and are attached on resilient brackets 42 at their bottom end, at 41, which hold the slip films 50 against the friction entrainment forces of the web 1, which runs from the bottom to the top.

The slip films 50, 50 rest directly on the web 1 and consist of a durable material which promotes slip, e.g. polytetrafluoroethylene or corrosion-resistant steel. Because of their attachment at 41, they hold the hose section 40 and therefore remain free of forces which act in the direction of movement of the web 1. The hose section 40 therefore has a purely sealing function, without any claims to mechanical strength or particularly good slip-promoting properties. In particular, the problem of sealing the spacer space between the bottom end 10' of the flat channel 10 and the sealing arrangement 20 is solved in a simple manner.

Figure 3:
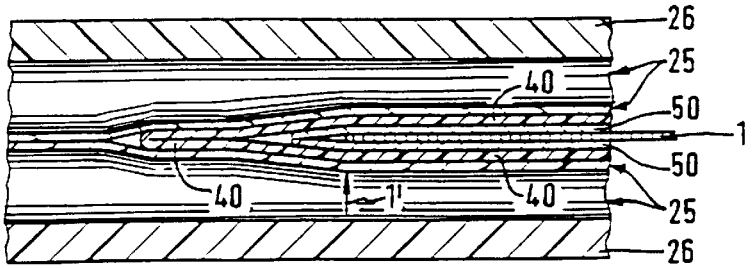
FIG. 3 shows a horizontal partial cross-section along the line III—III in FIG. 2.

FIG. 3 shows a horizontal cross-section at the height of the hoses 25, 25 in the edge region of the web 1. The thickness relationships are shown in exaggerated manner. Because of the elasticity of the hoses 25, 25, the slip films 50, 50 and the edges of the hose section 40 outside the edge 1' of the web are compressed and sealed by means of the interior pressure of the hoses 25, 25, so that an exact adaptation of the width of the web to the width of the slip films 50, 50 and the hose section 40 is not important.

In FIG. 1, the flat channel 10 is interrupted at the height of the location 19. This is to indicate that the height of the channel 10 and therefore of the impregnation section can be different, if necessary. In practice, a height of about 400–500 mm is possible.

Figure 5:
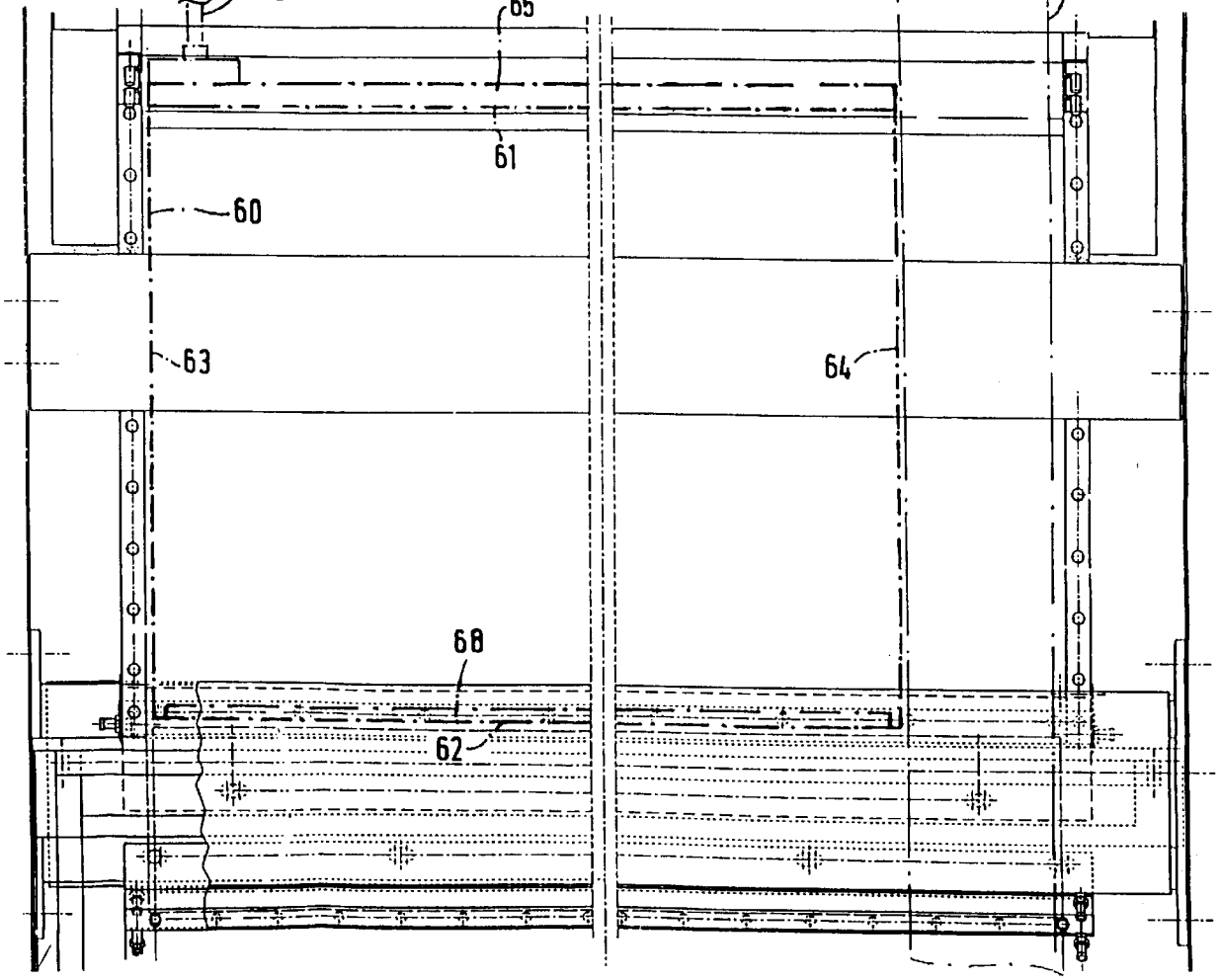
FIG. 5 shows a view according to FIG. 4 from the right.
Figure 4:
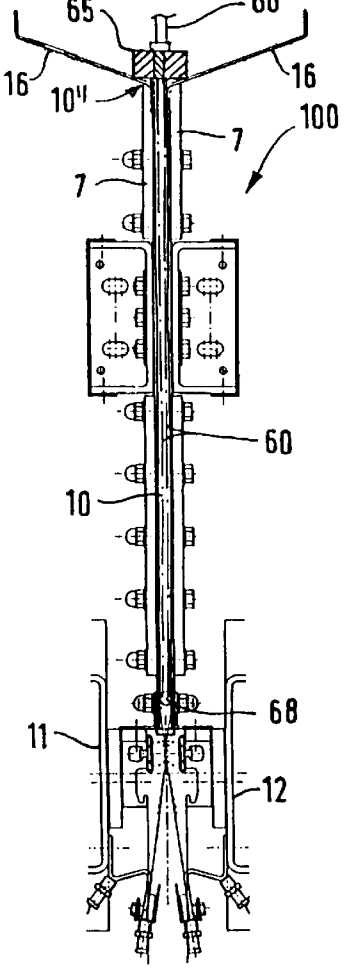
FIG. 4 shows a view of a different exemplary embodiment in a view corresponding to FIG. 1.

FIGS. 4 and 5 show a supplemental device which allows efficient and production-like manufacturing of sample strips 70 in the impregnation device 100. The supplemental device consists of an inflatable bag 60 made of plastic film, which is sealed except for a connection 66. The bag has a rectangular outline and is shown with heavy broken lines in FIG. 5. The bag 60 has a top edge 61, a bottom edge 62, and vertical edges 63, 64, the distance between which, i.e. the width of the bag 60, is less than the width of the flat channel 10, so that room remains for a narrow sample strip 70, on the right side in the exemplary embodiment. At the top edge 61 of the bag 60, a rigid strip 65 which covers the entire width is attached, closing the bag off towards the top and stabilizing it, and resting against the top edge 10" of the flat channel 10. A weighting rod 68 lies in the bottom of the bag 60.

If samples are to be produced, the bag 60 is suspended into the flat channel 10, which can easily be done because of the weighting rod 68 which pulls the bottom edge 62 of the bag 60 down. The rail 65 then rests against the top edge 10" of the flat channel 10. The bag is pumped up with air through the connection 66 on the rail 65, and then fills the left region of the flat channel 10 like a displacement element, in accordance with its width, between the vertical sides 63, 64, i.e. the sides which run parallel to the delimitations of the channel 10, so that no treatment liquid can penetrate there any more, and only the narrow region of the sample strip 70, which is not reached by the bag 60, remains free. Therefore only a very small amount of treatment liquid is necessary for producing the samples. Accordingly, production of the samples takes place in the same manner as subsequent production, so that the samples exactly reproduce the result of the treatment. After completion of production of the sample 70, the air is let out of the bag 60 and the bag is lifted out upwards, so that the entire working width is available again.

We claim:

1. A device for impregnating a web laterally guided in the width direction with a treatment liquid, the device comprising:

a tank through which the web is passed for impregnation with the treatment liquid as it traverses the tank in an upwardly direction, said tank having an upright flat channel that serves to contain the treatment liquid it is passed to the web, the upright flat channel having flat facing sides which are tightly opposed and configured to extend generally parallel to the web, wherein the upright flat channel has an upper end and a lower end;

a resilient sealing arrangement which is arranged substantially below the lower end of the upright flat channel and which presses on the web from both sides and wherein the upright flat channel can be kept charged with the treatment liquid to a desired level;

a means for guiding the web upwardly through the tank; and a pair of squeeze rollers for impinging on the web, said squeeze rollers being located above the tank so that they impinge upon the web after it has left the upright flat channel.

2. The device according to claim 1, wherein the resilient sealing arrangement comprises a flexible wall that extends crosswise across the web, and wherein said wall can be inflated by a fluid pressure medium so that it is pressed tightly against one side of the web and forms a seal therewith by pressing the web against a counter-surface on the other side of the web.

3. The device according to claim 2, further comprising an inflatable, flexible wall on each side of the web.

4. The device according to claim 3, wherein the flexible walls are formed by inflatable hoses which lie opposite one another.

5. The device according to claim 4, wherein the walls of the upright flat channel are made of a rigid material.

6. The device according to claim 1, wherein the walls of the upright flat channel are made of a rigid material.

7. The device according to claim 6, wherein the flat sides of the upright flat channel include two rectangular plates which are arranged opposite and parallel to one another at a distance, which are tightly connected with one another on upright edges by means of edge ridges made of a rectangular profile, arranged between them.

8. The device according to claim 7, wherein the distance between the flat sides of the upright flat channel is about 6 to 15 mm.

9. The device according to claim 6, wherein the distance between the flat sides of the upright flat channel is about 6 to 15 mm.

10. The device according to claim 9, wherein the upper end of the upright flat channel is open so that it can be supplied with the treatment liquid from above.

11. The device according to claim 1, wherein the upper end of the upright flat channel is open so that it can be supplied with the treatment liquid from above.

12. The device according to claim 11, further comprising run-off surfaces at the upper end of the upright flat channel, in a plane extending laterally from the channel, the run-off surfaces being inclined downward towards the inside of the channel, wherein the treatment liquid can be applied to the run-off surfaces from a location that is exterior to the channel.

13. The device according to claim 12, further comprising guide surfaces located on either side of the web, extending from below the pair of squeeze rollers downwardly to a position above the run-off surfaces, the guide surfaces directing flow of the treatment liquid from the squeeze rollers to the run-off surfaces.

14. The device according to claim 1, further comprising run-off surfaces at the upper end of the upright flat channel, in a plane extending laterally from the channel, the run-off surfaces being inclined downward towards the inside of the upright flat channel, wherein the treatment liquid can be applied to the run-off surfaces from a location that is exterior to the upright flat channel.

15. The device according to claim 14, further comprising guide surfaces located on either side of the web, extending from below the pair of squeeze rollers downwardly to a position above the run-off surfaces, the guide surfaces directing flow of the treatment liquid from the squeeze rollers to the run-off surfaces.

16. The device, according to claim 14, wherein the lower end of the upright flat channel terminates just above the sealing arrangement, and wherein the extending downwardly from the lower end of the upright flat channel is a section of hose which is closed in horizontal cross-section and which tightly surrounds the upright flat channel, wherein the hose section extends down through the sealing arrangement to below the sealing arrangement in a flattened state.

17. A device for impregnating a web laterally guided in the width direction with a treatment liquid, the device comprising:

a tank through which the web is passed for impregnation with the treatment liquid as it traverses the tank in an upwardly direction, said tank having an upright flat channel that serves to contain the treatment liquid it is passed to the web, the upright flat channel having flat facing sides which are tightly opposed and configured to extend generally parallel to the web, wherein the upright flat channel has an upper end and a lower end, the lower end being limited by a resilient sealing arrangement that can be brought to bear on the web from both sides and wherein the upright flat channel can be kept charged with the treatment liquid to a desired level; and a pair of squeeze rollers for impinging on the web, said squeeze rollers being located above the tank so that they impinge upon the web, after it has left the upright flat channel, wherein the lower end of the upright flat channel terminates just above the sealing arrangement, and wherein the extending downwardly from the lower end of the upright flat channel is a section of hose which is closed in horizontal cross-section and which tightly surrounds the upright flat channel, wherein the hose section extends down through the sealing arrangement to below the sealing arrangement in a flattened state.

18. The device according to claim 17, further comprising slip films which extend over the width of the web and are attached on the outside of the sides of the upright flat channel, but within the hose section, at their top edge, and extend downward through the sealing arrangement to below the sealing arrangement, wherein the slip films are fixed in place in movement direction of the web and rest against both sides of the web under pressure force of the sealing arrangement.

19. The device according to claim 18, further comprising at least one inflatable, flat, rectangular bag, wherein the rectangular bag is configured to be inserted into the upright flat channel such that it then extends, above the upright flat channel but extends across only a portion of the lateral width of the upright flat channel, said rectangular bag extending across the width defined by the facing sides of the upright flat channel when the rectangular bag, is inflated.

20. A device for impregnating a web laterally guided in the width direction with a treatment liquid, the device comprising:

a tank through which the web is passed for impregnation with the treatment liquid as it traverses the tank in an upwardly direction, said tank having an upright flat channel that serves to contain the treatment liquid it is passed to the web, the upright flat channel having flat facing sides which are tightly opposed and configured to extend generally parallel to the web, wherein the upright flat channel has an upper end and a lower end, the lower end being limited by a resilient sealing arrangement that can be brought to bear on the web from both sides and wherein the upright flat channel can be kept charged with the treatment liquid to a desired level;

a pair of squeeze rollers for impinging on the web, said squeeze rollers being located above the tank so that they impinge upon the web after it has left the upright flat channel; and at least one inflatable, flat, rectangular bag, wherein the rectangular bag is configured to be inserted into the upright flat channel such that it then extends above the upright flat channel but extends across only a portion of the lateral width of the upright flat channel, said rectangular bag extending across the width defined by the facing sides of the upright flat channel when the bag is inflated.

21. The device according to claim 20, further comprising a rigid strip affixed at a top edge of the bag, wherein the rigid strip can be set onto the top end of the upright flat channel.

22. The device according to claim 21, further comprising a connection on the rigid strip for inflating the bag.

23. The device according to claim 22, further comprising a weighting rod at the bottom edge of the bag.

24. The device according to claim 20, further comprising a weighting rod at the bottom edge of the bag.

* * * * *